US008496244B2

(12) United States Patent
Iljima et al.

(10) Patent No.: US 8,496,244 B2
(45) Date of Patent: Jul. 30, 2013

(54) SHEET PROCESSING APPARATUS AND SHEET PROCESSING METHOD

(75) Inventors: Tomomi Iljima, Shizuoka (JP); Yoshiaki Sugizaki, Shizuoka (JP); Jun Ishii, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 183 days.

(21) Appl. No.: 13/190,471

(22) Filed: Jul. 25, 2011

(65) Prior Publication Data

US 2012/0025456 A1 Feb. 2, 2012

Related U.S. Application Data

(60) Provisional application No. 61/368,622, filed on Jul. 28, 2010, provisional application No. 61/431,378, filed on Jan. 10, 2011, provisional application No. 61/431,379, filed on Jan. 10, 2011.

(51) Int. Cl.
*B65H 31/26* (2006.01)

(52) U.S. Cl.
USPC ..... 271/220; 271/306; 271/176

(58) Field of Classification Search
USPC . 271/176, 178, 220, 306; 270/58.07; 399/407
See application file for complete search history.

(56) References Cited

U.S. PATENT DOCUMENTS

| | | | | |
|---|---|---|---|---|
| 4,770,405 | A * | 9/1988 | Fukushima et al. | 271/176 |
| 5,931,460 | A * | 8/1999 | Kadowaki et al. | 271/220 |
| 7,591,468 | B2 * | 9/2009 | Ryan et al. | 271/306 |
| 7,740,239 | B2 * | 6/2010 | Tsuchihashi | 270/58.07 |
| 7,871,069 | B2 * | 1/2011 | Lee et al. | 271/178 |
| 8,028,983 | B2 * | 10/2011 | Taki et al. | 270/58.07 |
| 2004/0201165 | A1 * | 10/2004 | Kamiya et al. | 271/220 |
| 2006/0078363 | A1 * | 4/2006 | Terao et al. | 399/407 |
| 2006/0214346 | A1 * | 9/2006 | Terao et al. | 270/58.08 |
| 2007/0057443 | A1 * | 3/2007 | Terao et al. | 271/221 |
| 2008/0001352 | A1 * | 1/2008 | Jeong | 271/306 |
| 2008/0136090 | A1 * | 6/2008 | Bober | 271/221 |
| 2010/0244369 | A1 * | 9/2010 | Terao et al. | 271/220 |

* cited by examiner

*Primary Examiner* — Michael McCullough
*Assistant Examiner* — Howard Sanders
(74) *Attorney, Agent, or Firm* — Patterson & Sheridan, L.L.P.

(57) ABSTRACT

A sheet processing apparatus includes a control section configured to control a rotating speed of a longitudinal alignment roller, which is set on a recording medium stacking surface of a processing tray and configured to align a recording medium in a longitudinal direction, such that acceleration and deceleration of the rotating speed is performed at least twice during one longitudinal alignment operation and a paddle including a striking paddle configured to strike the recording medium, a dropping paddle configured to drop the recording medium, a draw-in paddle configured to draw the recording medium in a direction of a stopper, a dropping-paddle supporting member configured to support the dropping paddle from the back in a rotating direction of the paddle, and a draw-in-paddle supporting member configured to support the draw-in paddle from the back in the rotating direction.

20 Claims, 8 Drawing Sheets

SHEET PROCESSING APPARATUS AND SHEET PROCESSING METHOD

CROSS-REFERENCE TO RELATED APPLICATIONS

This application is based upon and claims the benefit of priority from the prior U.S. Patent Application No. 61/368,622, filed on 28 Jul. 2010, the prior U.S. Patent Application No. 61/431,378, filed on 10 Jan. 2011, the prior U.S. Patent Application No. 61/431,379, filed on 10 Jan. 2011, and the entire contents of which are incorporated herein by reference.

FIELD

Embodiments described herein relate generally to a sheet processing apparatus and a sheet processing method.

BACKGROUND

A sheet processing apparatus set adjacent to an image forming apparatus receives a recording medium subjected to image formation from the image forming apparatus and performs stapling and saddle folding.

The processing speed of the sheet processing apparatus is lower than the image forming speed of the image forming apparatus. The sheet processing apparatus includes, in order to absorb this speed difference, a waiting tray on which plural recording media received from the image forming apparatus are temporarily stacked and a processing tray configured to receive the recording media from the waiting tray and align the recording media before stapling is performed.

The sheet processing apparatus stacks the plural recording media received from the image forming apparatus on the waiting tray and, when stapling of preceding recording media ends, drops following recording media from the waiting tray to the processing tray.

The sheet processing apparatus aligns the recording media received by the processing tray using a lateral alignment device and a longitudinal alignment device.

The longitudinal alignment device includes a paddle set above the processing tray and configured to strike down the recording media and draw in the recording media to bump the recording media against a stopper and a longitudinal alignment roller configured to convey the stacked recording media to bump the recording media against the stopper.

The paddle is formed of a flexible material. The recording media received from the image forming apparatus are heated. Therefore, in the sheet processing apparatus in the past, the paddle is softened by the heat of the recording media and an alignment failure of longitudinal alignment occurs.

An aligning ability of the longitudinal alignment roller is higher as the longitudinal alignment roller rotates faster. However, if the number of revolutions of the longitudinal alignment roller is excessively increased when frictional force on surfaces of the recording media is small, a slip occurs and an alignment failure of longitudinal alignment occurs.

The paddle of the sheet processing apparatus in the past is set in a place deviating from a place right above the longitudinal alignment roller. Therefore, a grip of the recording media by the paddle and the longitudinal alignment roller is weak and an alignment failure of longitudinal alignment occurs.

Therefore, there is a demand for a sheet processing apparatus and a sheet processing method that can accurately perform longitudinal alignment irrespective of a degree of friction on the surfaces of recording media and even if a paddle is softened by the heat of the recording media.

DETAILED DESCRIPTION

A sheet processing apparatus according to an exemplary embodiment is explained in detail below with reference to the accompanying drawings.

The sheet processing apparatus according to this embodiment includes: a waiting tray on which a recording medium received from an image forming apparatus is temporarily stacked; a processing tray set below the waiting tray, the recording medium received from the waiting tray being stacked on the processing tray; a paddle set above the processing tray and configured to align the recording medium stacked on the processing tray in a longitudinal direction; a paddle driving device configured to drive the paddle; a longitudinal alignment roller set on a recording medium stacking surface of the processing tray and configured to align the recording medium in the longitudinal direction; a longitudinal-alignment-roller driving device configured to drive the longitudinal alignment roller; and a control section configured to control the longitudinal-alignment-roller driving device such that the longitudinal alignment roller performs acceleration and deceleration of rotating speed at least twice during one longitudinal alignment operation.

Figure 1:
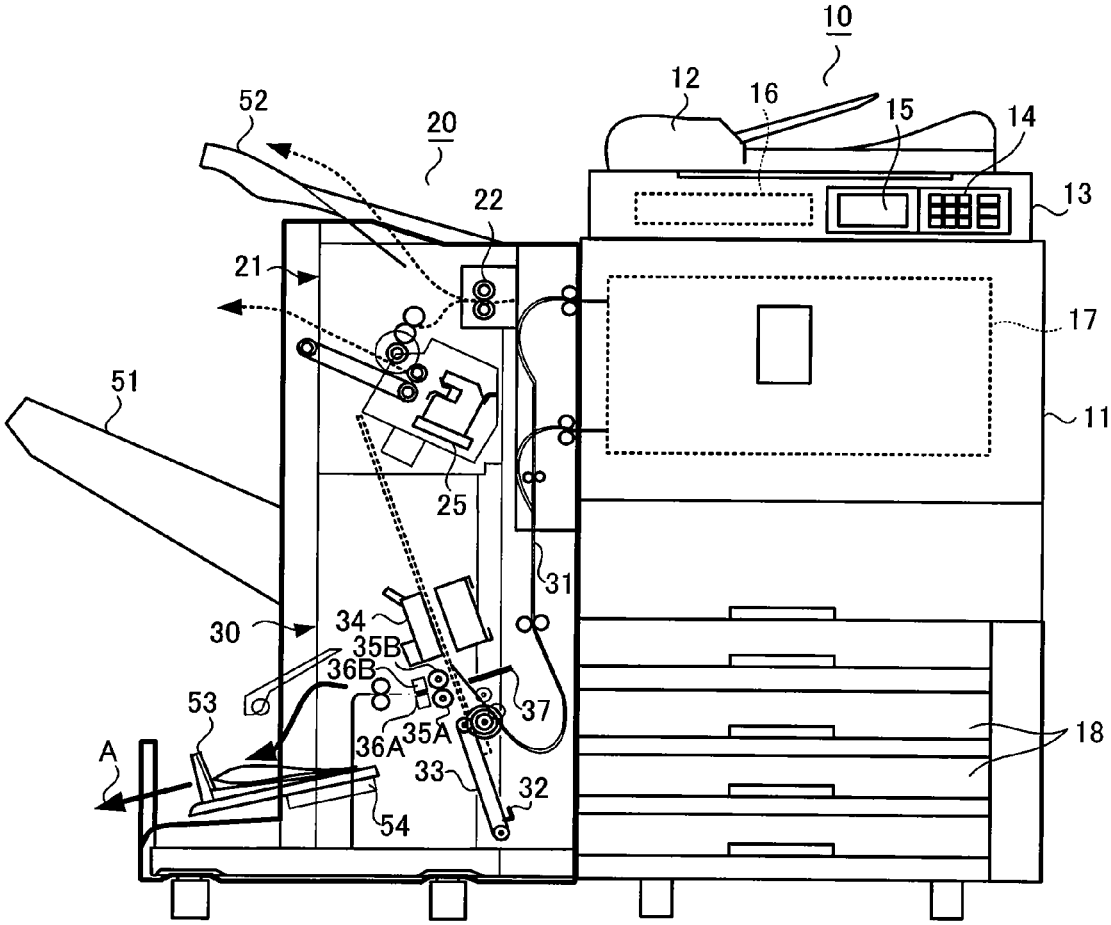
FIG. 1 is a side sectional view of an image forming apparatus.

FIG. 1 is a side sectional view of an image forming apparatus 10 according to this embodiment. As shown in FIG. 1, a sheet processing apparatus 20 is set adjacent to the image forming apparatus 10 such as a copying machine, an MFP (Multifunction Peripheral), or a printer.

The image forming apparatus 10 includes an auto document feeder 12 configured to feed original documents one by one, a scan unit 16 configured to read the original document, and sheet cassettes 18 configured to store recording media. The image forming apparatus 10 further includes a main body section 11 in which an image forming section 17 configured to form an image on the recording media conveyed one by one from the sheet cassettes 18 is housed and a control section 13 including a control panel 15 and operation buttons 14. The image forming apparatus 10 passes the recording medium having the image formed thereon to the sheet processing apparatus 20.

The sheet processing apparatus 20 includes a stapling mechanism 21 configured to perform stapling and a saddle folding unit 30 configured to perform saddle folding.

The stapling mechanism 21 includes a stapler 25 configured to staple recording media conveyed by conveying roller 22.

If neither the stapling nor the saddle folding is performed, the recording media are discharged to a paper discharge tray 52 at an upper stage. The stapled recording media are discharged to a movable paper discharge tray 51 in a middle stage.

The saddle folding unit 30 includes a conveying mechanism 31 configured to convey a recording medium, a longitudinal alignment device 32 configured to temporarily stack the conveyed recording medium and align the recording medium in a longitudinal direction, and a moving device 33 configured to convey the aligned recording medium to a stapling position or a saddle folding position.

The saddle folding unit 30 includes a stapler 34 and a saddle folding mechanism. The saddle folding mechanism includes a saddle-folding driving roller 35A and a saddle-folding driven roller 35B, which are a pair of saddle folding rollers, configured to saddle-fold recording media, a saddle folding blade 37 configured to push the recording media into a nip section between the saddle-folding driving roller 35A and the saddle-folding driven roller 35B, and an additional folding unit 36 configured to additionally fold the saddle-folded recording media.

The additional folding unit 36 includes a lower additional folding roller 36A and an upper additional folding roller 36B, which are a pair of additional folding rollers.

The saddle folding rollers have a rotation axis in a direction perpendicular to a sheet conveying direction. The additional folding rollers have a rotation axis in parallel to the sheet conveying direction.

The additional folding unit 36 holds a fold of the recording media saddle-folded by the lower additional folding roller 36A and the upper additional folding roller 36B, moves along the rotation axis of the saddle folding rollers, and additionally folds the fold.

When stapling is performed, the recording media are first conveyed to the stapling position and stapled by the stapling mechanism 21. Subsequently, the stapled recording media are saddle-folded by the saddle folding unit 30.

The saddle-folded recording media are discharged to a stacking tray 53. The stacking tray 53 includes a stacking-tray moving mechanism 54 under the stacking tray 53. The stacking-tray moving mechanism 54 moves, every time the saddle-folded recording media are discharged, the stacking tray 53 by predetermined length in a direction of an arrow A, i.e., a direction in which the recording media are discharged. Therefore, bundles of the saddle-folded recording media are stacked on the stacking tray 53 while being shifted from one another by the predetermined length.

The sheet processing apparatus 20 may include an up-down direction alignment device configured to discharge, in every printing job, bundles of the recording media discharged to the stacking tray 53 to shift the bundles of the recording media in a vertical direction, i.e., in a depth direction or a front direction viewed from an operator.

Figure 2:
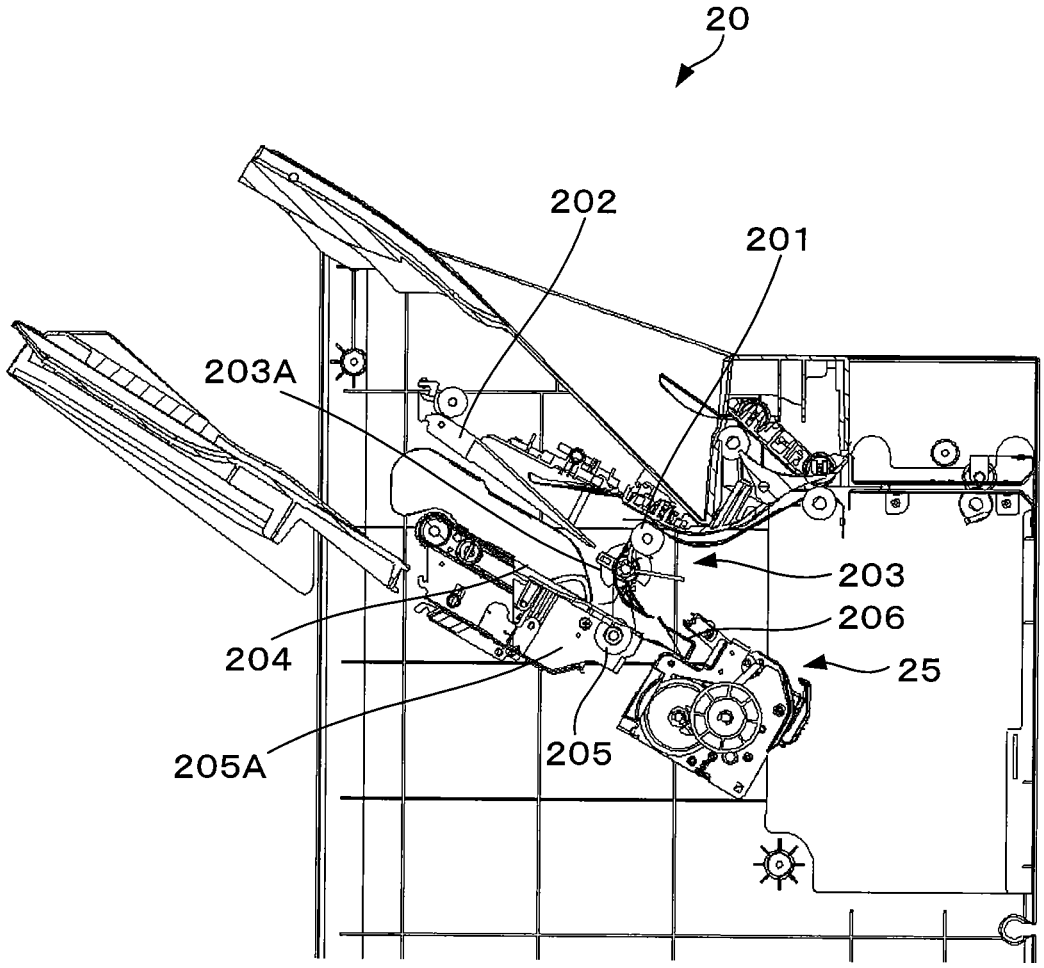
FIG. 2 is an enlarged side view of a section near a processing tray of a sheet processing apparatus.

FIG. 2 is an enlarged side view of a section near a processing tray 204 of the sheet processing apparatus 20. As shown in FIG. 2, the sheet processing apparatus 20 includes a paper discharge roller 201 configured to discharge a recording medium received from the image forming apparatus 10, a waiting tray 202 on which the recording medium discharged from the paper discharge roller 201 is temporarily stacked, the processing tray 204 set below the waiting tray 202, the recording medium to be stapled being stacked on the processing tray 204, a paddle 203 set above the processing tray 204 and configured to align the recording medium stacked on the processing tray 204 in the longitudinal direction, a paddle driving device 203A configured to drive the paddle 203, a longitudinal alignment roller 205 set on a recording medium stacking surface of the processing tray 204 and configured to align the recording medium in the longitudinal direction, a longitudinal-alignment-roller driving device 205A configured to drive the longitudinal alignment roller 205, and a stopper 206 set in the processing tray 204 and configured to regulate conveyance of the recording medium to be longitudinally aligned and align the recording medium.

For example, three recording media discharged from the paper discharge roller 201 are stacked on the waiting tray 202. After the three recording media are stacked on the waiting tray 202, the waiting tray 202 opens to the left and right and drops the recording media to the processing tray 204.

The processing tray 204 includes a lateral alignment device configured to reciprocatingly move in a width direction of the recording media.

The recording media stacked on the processing tray 204 are aligned in a lateral direction by the lateral alignment device and aligned in the longitudinal direction by the paddle 203 and the longitudinal alignment roller 205.

The paddle 203 and the longitudinal alignment roller 205 perform alignment in the longitudinal direction by bumping the recording media against the stopper 206.

The stapler 25 staples the aligned recording media.

Figure 3:
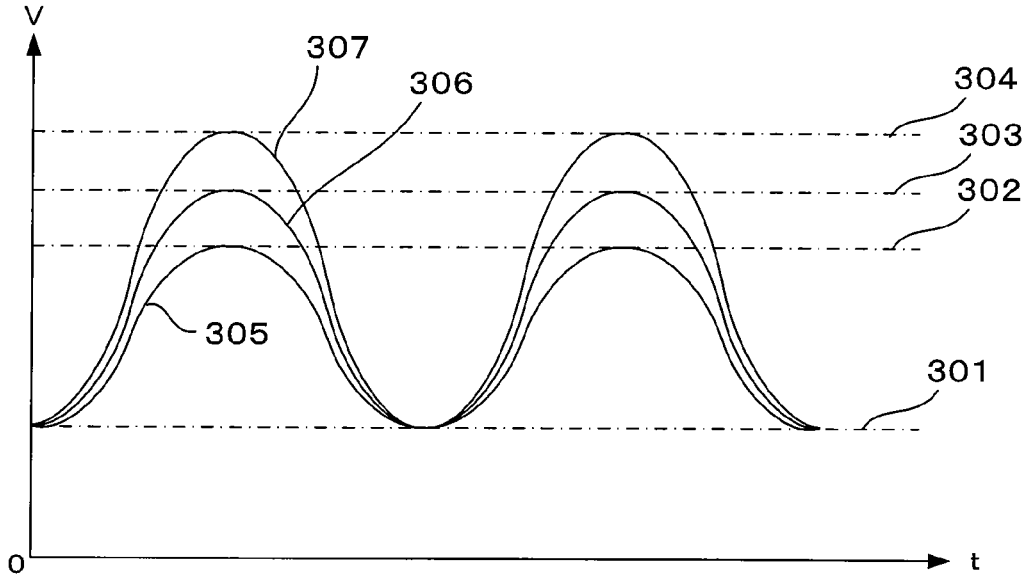
FIG. 3 is a graph of a change in rotating speed in one longitudinal alignment operation of a longitudinal alignment roller.

FIG. 3 is a graph of a change in rotating speed in one longitudinal alignment operation of the longitudinal alignment roller 205. The ordinate indicates the rotating speed of the longitudinal alignment roller 205 and the abscissa indicates time. A graph 306 indicates setting for a recording medium having normal-level surface friction. A graph 307 indicates setting for a recording medium having surface friction larger than the normal level. A graph 305 indicates setting for a recording medium having surface friction smaller than the normal level.

As shown in FIG. 3, the sheet processing apparatus 20 performs acceleration and deceleration of the rotating speed of the longitudinal alignment roller 205 at least twice during one longitudinal alignment operation.

In the case of the recording medium having the normal-level surface friction, with a graph 303, which indicates speed obtained by an experiment at which the recording medium starts to slip, set as a maximum, acceleration and deceleration of the rotating speed of the longitudinal alignment roller 205 are performed at least twice during one longitudinal alignment operation.

As the rotating speed of the longitudinal alignment roller 205 is higher, alignability of longitudinal alignment is improved. However, if the rotating speed of the longitudinal alignment roller 205 exceeds fixed speed, the recording medium causes a slip and alignment accuracy is deteriorated.

By performing acceleration and deceleration of the rotating speed of the longitudinal alignment roller 205 at least twice, it is possible to improve alignability of longitudinal alignment while suppressing occurrence of a slip of the recording medium.

In the case of the recording medium having the surface friction larger than the normal level, with a graph 304, which indicates speed obtained by an experiment at which the recording medium starts to slip, set as a maximum, acceleration and deceleration of the rotating speed of the longitudinal alignment roller 205 are performed at least twice during one longitudinal alignment operation.

Specifically, in the case of the recording medium having the surface friction larger than the normal level, the maximum rotating speed of the longitudinal alignment roller 205 is set higher than the rotating speed in the case of the recording medium having the normal-level surface friction.

In the case of the recording medium having the surface friction smaller than the normal level, with a graph 302, which indicates speed obtained by an experiment at which the recording medium starts to slip, set as a maximum, acceleration and deceleration of the rotating speed of the longitudinal alignment roller 205 are performed at least twice during one longitudinal alignment operation.

Specifically, in the case of the recording medium having the surface friction smaller than the normal level, the maximum rotating speed of the longitudinal alignment roller 205 is set lower than the rotating speed in the case of the recording medium having the normal-level surface friction.

In the case of all the recording media, a minimum 301 is the minimum rotating speed of the longitudinal alignment roller 205 at which longitudinal alignment can be effectively performed.

Setting of the maximum of the rotating speed can be performed by setting the maximum from a control panel.

The sheet processing apparatus 20 may include a correspondence table in which the maximum of the rotating speed set in advance according to a type of a recording medium is stored. In this case, the sheet processing apparatus 20 may perform setting of the maximum of the rotating speed by reading the maximum of the rotating speed from the correspondence table on the basis of a type of a recording medium set in a host apparatus such as a control panel or a personal computer.

Figure 4:
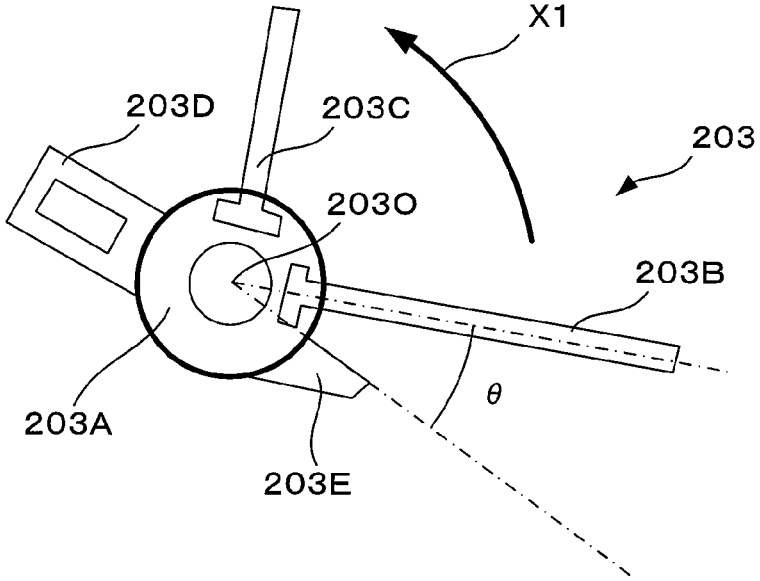
FIG. 4 is a side view of the configuration of a paddle.

FIG. 4 is a side view of the configuration of the paddle 203. As shown in FIG. 4, the paddle 203 includes a paddle roller 203A configured to rotate around a rotation axis 2030, a striking paddle 203D provided in the paddle roller 203A from upstream to downstream of a rotating direction X1 of the paddle 203 and configured to strike a recording medium, a dropping paddle 203C configured to drop the recording medium, a draw-in paddle 203B configured to draw the recording medium in a direction of the stopper 206, and a supporting member 203E configured to support the draw-in paddle 203B from the back in a rotating direction.

The supporting member 203E has length in the radial direction smaller than that of the draw-in paddle 203B and is set a center angle θ apart from the draw-in paddle 203B. The center angle θ is desirably equal to or larger than 20° and equal to or smaller than 45°.

As a material of the supporting member 203E, resin, for example, ABS (acrylonitrile butadiene styrene) can be used.

Figure 5:
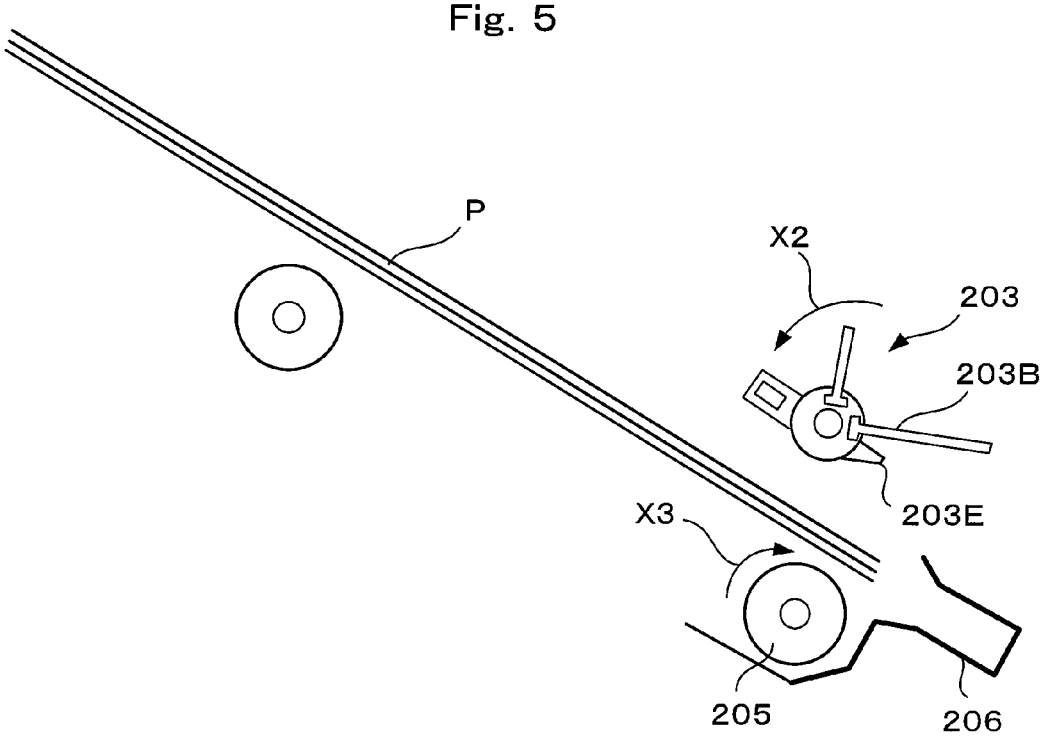
FIG. 5 is a diagram for explaining the operations of the paddle and the longitudinal alignment roller.
Figure 6:
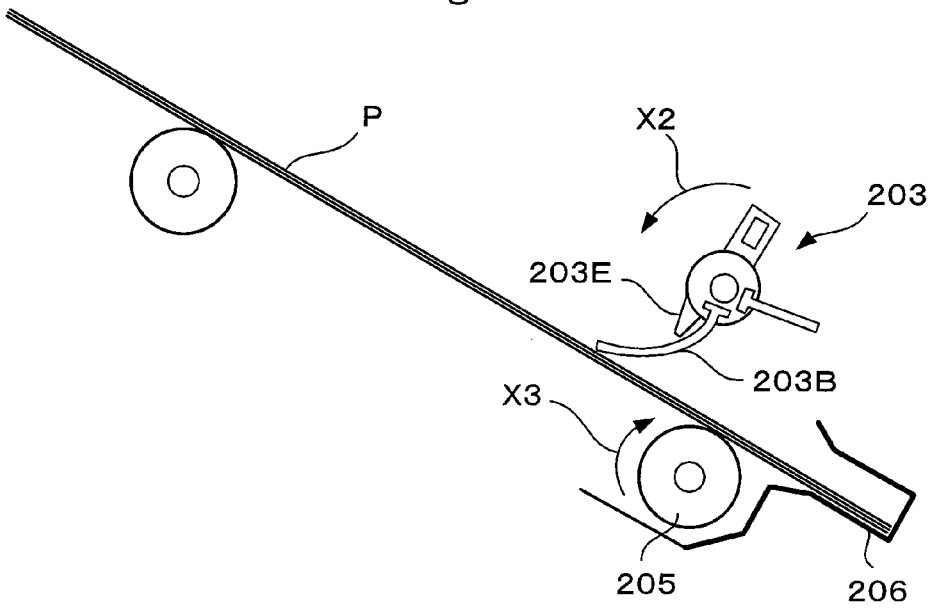
FIG. 6 is a diagram for explaining the operations of the paddle and the longitudinal alignment roller.

FIGS. 5 and 6 are diagrams for explaining the operations of the paddle 203 and the longitudinal alignment roller 205. As shown in FIGS. 5 and 6, the sheet processing apparatus 20 rotates the paddle 203 in an arrow X2 direction and rotates the longitudinal alignment roller 205 in an arrow X3 direction at timing when a recording medium P drops from the waiting tray 202 to the processing tray 204.

The striking paddle 203D strikes the recording medium P. The dropping paddle 203C drops the recording medium P. The draw-in paddle 203B draws the recording medium in the direction of the stopper 206.

As shown in FIG. 6, the draw-in paddle 203B is supported by the supporting member 203E from the back in the paddle rotating direction X2.

Therefore, even if the draw-in paddle 203B is softened by the heat of the recording medium P, draw-in force does not fall and alignment accuracy is not deteriorated.

Figure 7:
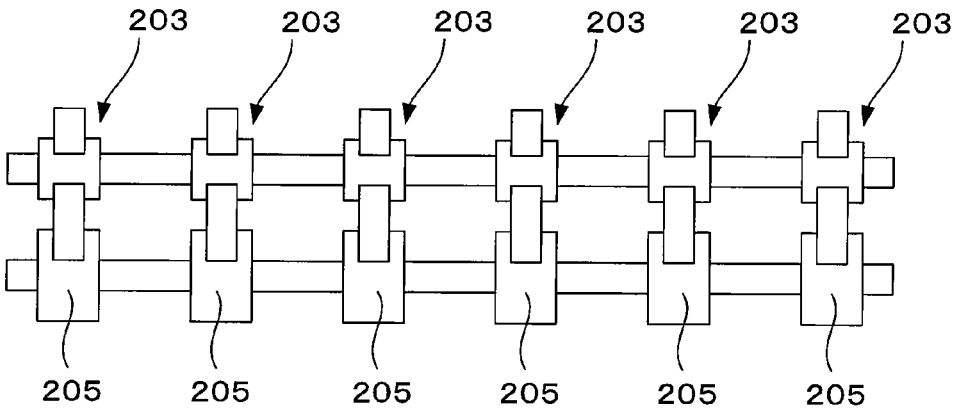
FIG. 7 is a diagram for explaining a positional relation between the paddle and the longitudinal alignment roller.

FIG. 7 is a diagram for explaining a positional relation between the paddle 203 and the longitudinal alignment roller 205. As shown in FIG. 7, the paddle 203 is arranged right above the longitudinal alignment roller 205.

Therefore, since a recording medium is aligned by being held between the draw-in paddle 203B and the longitudinal alignment roller 205, alignment accuracy of longitudinal alignment is improved.

Figure 8:
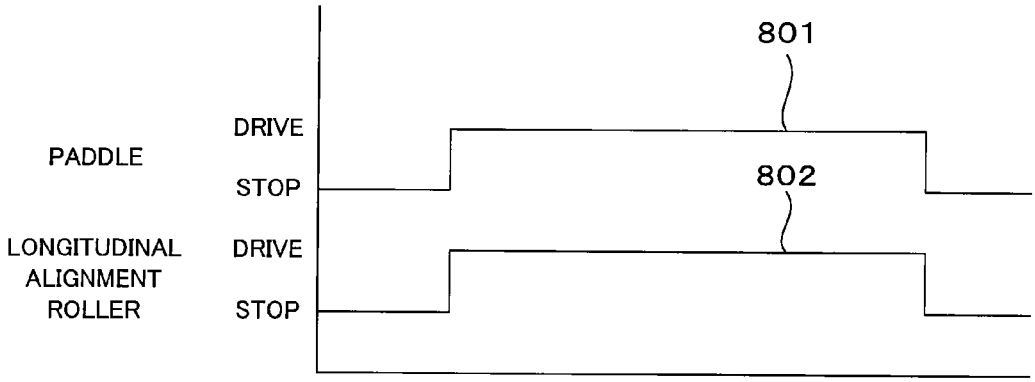
FIG. 8 is a timing chart for explaining driving timings for the paddle and the longitudinal alignment roller.

FIG. 8 is a timing chart for explaining driving timings for the paddle 203 and the longitudinal alignment roller 205.

As shown in FIG. 8, when the longitudinal alignment roller 205 is driven, the paddle 203 is driven in synchronization with the longitudinal alignment roller 205. When the longitudinal alignment roller 205 is stopped, the paddle 203 is stopped in synchronization with the longitudinal alignment roller 205.

Therefore, the paddle 203 does not scratch the longitudinal alignment roller 205.

Figure 9:
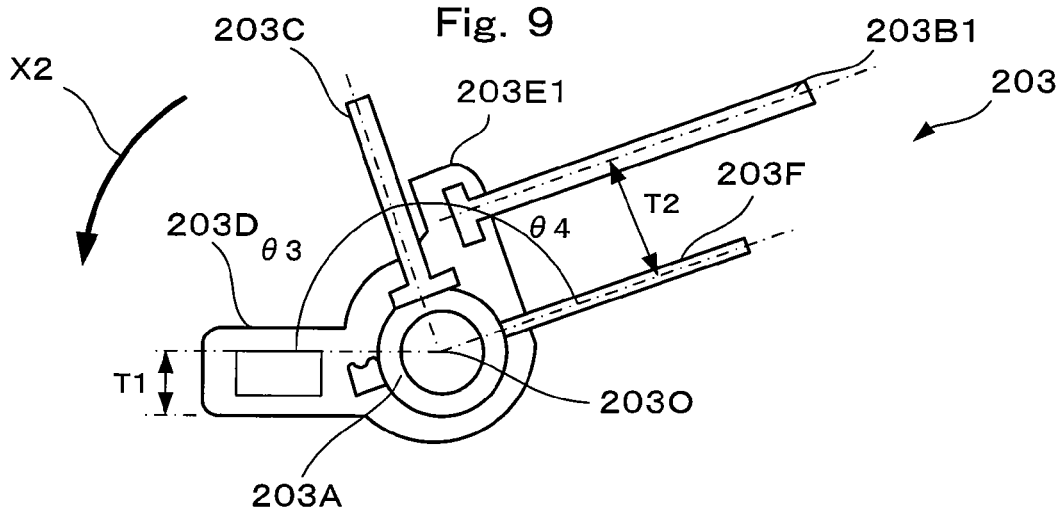
FIG. 9 is a side view of a paddle according to an application example.

FIG. 9 is a side view of the paddle 203 according to an application example. As shown in FIG. 9, the paddle 203 includes the paddle roller 203A configured to rotate around the rotation axis 2030, the striking paddle 203D provided in the paddle roller 203A from upstream to downstream of the rotating direction X2 of the paddle 203 and configured to strike a recording medium, the dropping paddle 203C configured to drop the recording medium, a draw-in paddle 203B1 configured to draw the recording medium in the direction of the stopper 206, a dropping-paddle supporting member 203E1 configured to support the dropping paddle 203C from the back in the rotating direction, and a draw-in-paddle supporting member 203F configured to support the draw-in paddle 203B1 from the back in the rotating direction.

The striking paddle 203D has a thickness T1 with respect to a radius passing the rotation axis 2030 of the paddle roller 203A.

The dropping paddle 203C is arranged an acute center angle θ3 apart from the striking paddle 203D.

The draw-in-paddle supporting member 203F is arranged an acute center angle θ4 apart from the dropping paddle 203C.

The draw-in paddle 203B1 is set in the dropping-paddle supporting member 203E1 a width T2 apart from and in parallel to the draw-in-paddle supporting member 203F. Specifically, the draw-in paddle 203B1 is set to be translated to the upstream side in the rotating direction by the width T2 with respect to the radius of the paddle roller 203A.

The draw-in-paddle supporting member 203F is shorter than the draw-in paddle 203B1.

The width T2 is smaller than length from the rotation axis 203O to a distal end of the dropping paddle 203C.

Figure 10:
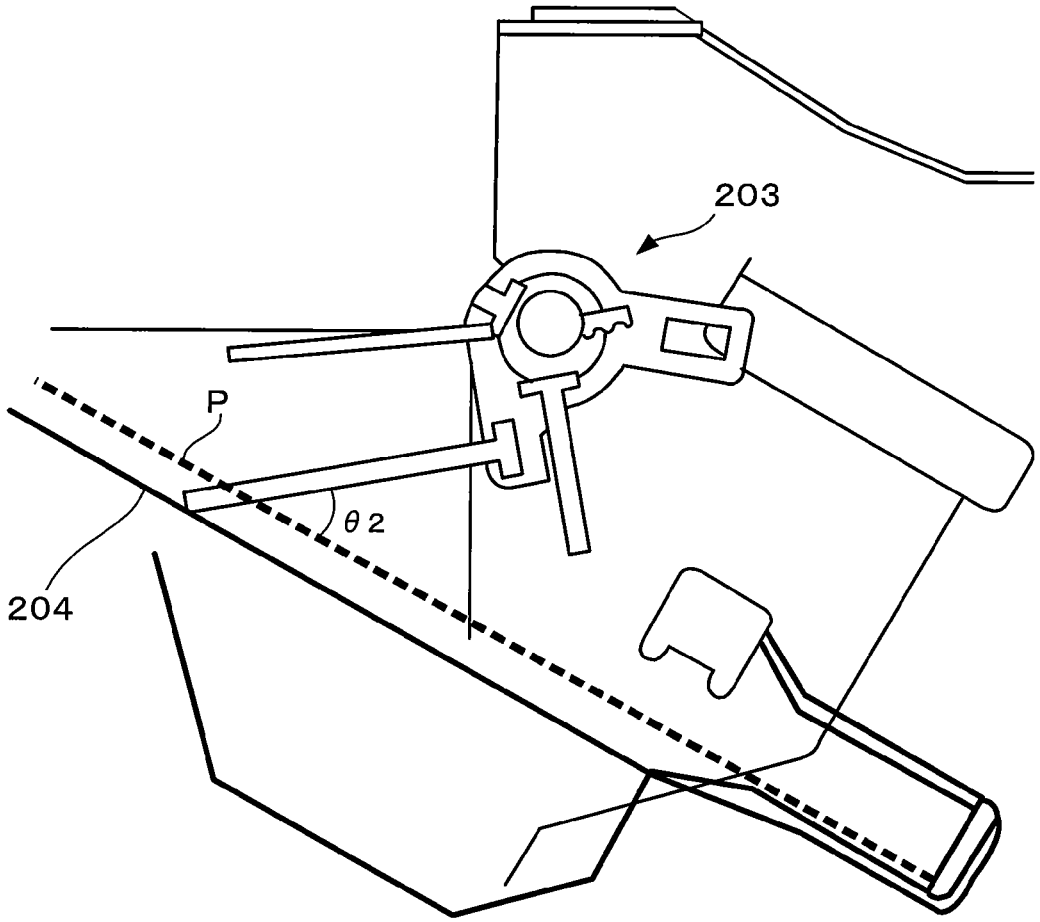
FIG. 10 is a diagram for explaining the operation of the paddle according to the application example.
Figure 11:
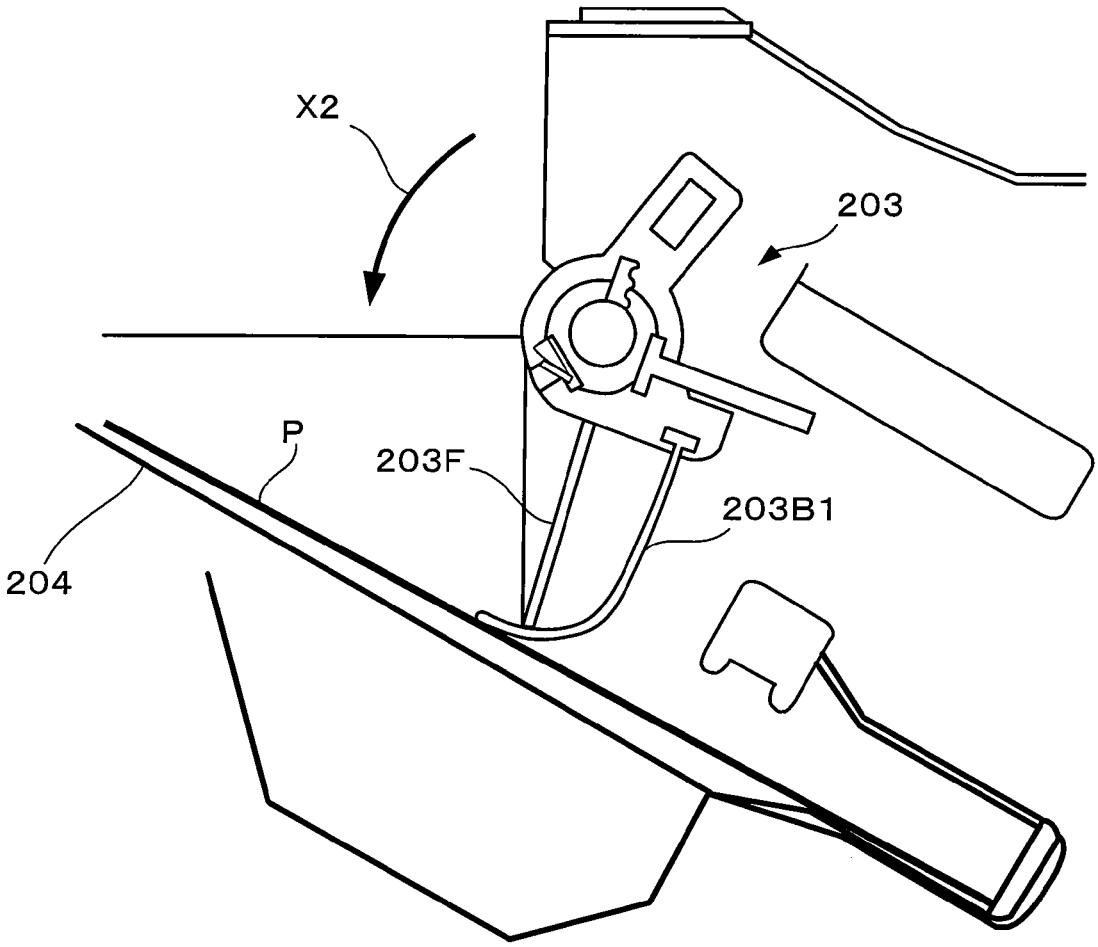
FIG. 11 is a diagram for explaining the operation of the paddle according to the application example.

FIGS. 10 and 11 are diagrams for explaining the operation of the paddle 203 according to the application example.

As shown in FIG. 10, since the draw-in paddle 203B1 is set to be translated to the upstream side in the rotating direction by the width T2 with respect to the radius of the paddle roller 203A, the draw-in paddle 203B1 is in contact with the recording medium P, which is stacked on the processing tray 204, at an angle θ2.

The angle θ2 is smaller than a contact angle with a recording medium of the draw-in paddle 203B1 set on the radius of the paddle roller 203A.

Therefore, a contact area of the draw-in paddle 203B1 and the recording medium increases and frictional force between the draw-in paddle 203B1 and the recording medium increases. When the frictional force between the draw-in paddle 203B1 and the recording medium increases, alignment accuracy of longitudinal alignment is improved.

As shown in FIG. 11, the length of the draw-in-paddle supporting member 203F is larger than the length of the draw-in-paddle supporting member 203F contacting with the draw-in paddle 203B1 rotated to a position where the draw-in paddle 203B1 is in contact with the recording medium on the processing tray 204.

If the draw-in paddle 203B1 is softened by the heat of the recording medium, the draw-in-paddle supporting member 203F supports the draw-in paddle 203B1 from the back in the rotating direction.

If the dropping paddle 203C is softened by the heat of the recording medium, the dropping-paddle supporting member 203E1 supports the dropping paddle 203C from the back in the rotating direction.

Therefore, even if the draw-in paddle 203B1 and the dropping paddle 203C are softened by the heat of the recording medium, alignment accuracy of longitudinal alignment is not deteriorated.

Figure 12:
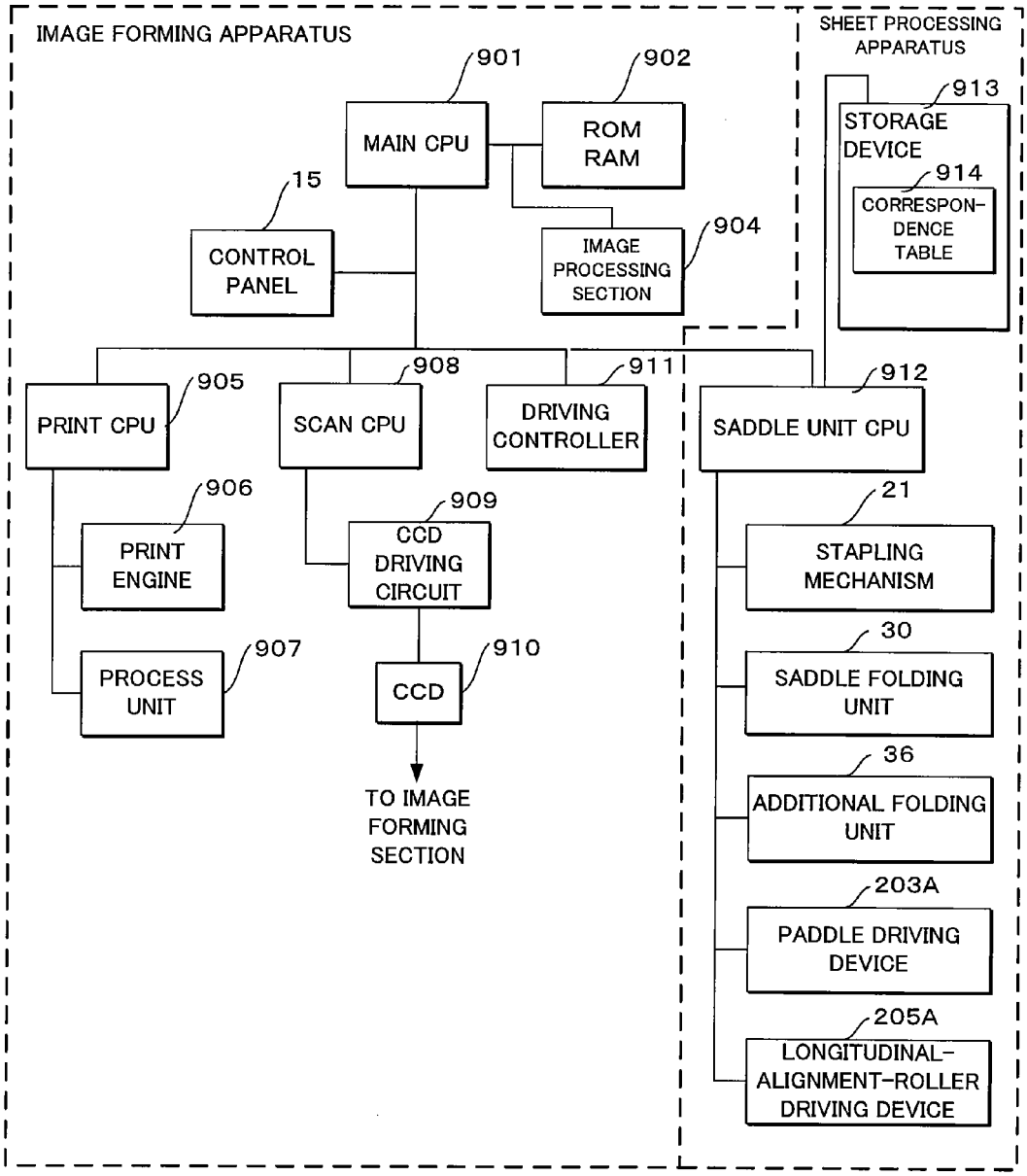
FIG. 12 is a block diagram of a control system of the image forming apparatus and the sheet processing apparatus.

FIG. 12 is a block diagram of a control system of the image forming apparatus 10 and the sheet processing apparatus 20. As shown in FIG. 12, the image forming apparatus 10 includes a main CPU 901 configured to control the entire image forming apparatus 10, the control panel 15 connected to the main CPU 901, a memory 902 such as a ROM and a RAM, which are storage devices, an image processing section 904 configured to perform image processing, a print CPU 905 configured to control printing, a scan CPU 908 configured to control the scan unit 16, a driving controller 911 configured to control a conveying roller for a recording medium, and a saddle unit CPU 912, which is a control section configured to control the sheet processing apparatus 20.

The main CPU 901 is connected to a computer such as a personal computer or a server via an interface.

The print CPU 905 controls a print engine 906 configured to perform image formation and a process unit 907 configured to apply fixing processing to a recording medium subjected to the image formation.

The scan CPU 908 controls a CCD driving circuit 909 configured to drive a CCD (Charge Coupled Device) 910.

The saddle unit CPU 912, which is the control section, controls a storage device 913 configured to store a correspondence table 914, the stapling mechanism 21, the saddle folding unit 30, the additional folding unit 36, the paddle driving device 203A, and the longitudinal-alignment-roller driving device 205A. The saddle folding unit 30 includes a saddle-folding-blade driving section configured to drive the saddle folding blade 37 and a folding motor configured to drive the saddle-folding driving roller 35A.

As explained above, the sheet processing apparatus 20 according to this embodiment includes the control section configured to control the rotating speed of the longitudinal alignment roller 205, which is set on the recording medium stacking surface of the processing tray 204 and configured to align a recording medium in the longitudinal direction, such that acceleration and deceleration of the rotating speed is performed at least twice during one longitudinal alignment operation and the paddle 203 including the striking paddle 203D configured to strike the recording medium, the dropping paddle 203C configured to drop the recording medium, the draw-in paddle 203B1 configured to draw the recording medium in the direction of the stopper 206, the dropping-paddle supporting member 203E1 configured to support the dropping paddle 203C from the back in the rotating direction, and the draw-in-paddle supporting member 203F configured to support the draw-in paddle 203B1 from the back in the rotating direction.

Therefore, the sheet processing apparatus 20 according to this embodiment has an effect that longitudinal alignment can be accurately performed irrespective of a degree of friction on surfaces of recording media and even if the draw-in paddle 203B1 and the dropping paddle 203C are softened by the heat of the recording media.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. A sheet processing apparatus comprising:

a waiting tray on which a recording medium received from an image forming apparatus is temporarily stacked;

a processing tray set below the waiting tray, the recording medium received from the waiting tray being stacked on the processing tray;

a paddle set above the processing tray and configured to align the recording medium stacked on the processing tray in a longitudinal direction;

a paddle driving device configured to drive the paddle;

a longitudinal alignment roller set on a recording medium stacking surface of the processing tray and configured to align the recording medium in the longitudinal direction;

a longitudinal-alignment-roller driving device configured to drive the longitudinal alignment roller; and a control section configured to control the longitudinal-alignment-roller driving device such that the longitudinal alignment roller performs acceleration and deceleration of rotating speed at least twice during one longitudinal alignment operation.

2. The apparatus according to claim 1, wherein the control section sets a maximum of the rotating speed of the longitudinal alignment roller according to a type of the recording medium.

3. The apparatus according to claim 2, further comprising a correspondence table in which a maximum of the rotating speed set in advance according to the type of the recording medium is stored, wherein the control section sets the maximum of the rotating speed by reading the maximum of the rotating speed from the correspondence table on the basis of the type of the recording medium.

4. The apparatus according to claim 1, wherein the paddle includes:

a paddle roller configured to rotate around a rotation axis;

a striking paddle configured to strike the recording medium;

a dropping paddle configured to drop the recording medium;

a draw-in paddle configured to draw in the recording medium; and a supporting member configured to support the draw-in paddle from a back in a rotating direction of the paddle.

5. The apparatus according to claim 4, wherein the paddle is arranged right above the longitudinal alignment roller.

6. The apparatus according to claim 5, wherein, when the longitudinal alignment roller is driven, the paddle is driven in synchronization with the longitudinal alignment roller and, when the longitudinal alignment roller is stopped, the paddle is stopped in synchronization with the longitudinal alignment roller.

7. The apparatus according to claim 6, wherein the paddle further includes a dropping-paddle supporting member configured to support the dropping paddle from the back in the rotating direction.

8. The apparatus according to claim 7, wherein the paddle includes the draw-in paddle in the dropping-paddle supporting member.

9. The apparatus according to claim 8, wherein the paddle further includes a draw-in-paddle supporting member configured to support the draw-in paddle from the back in the rotating direction.

10. The apparatus according to claim 9, wherein the draw-in paddle is set to be translated to an upstream side in the rotating direction with respect to a radius of the paddle roller.

11. A sheet processing method comprising:

causing a longitudinal alignment roller, which is set on a recording medium stacking surface of a processing tray and configured to align a recording medium in a longitudinal direction, to perform acceleration and deceleration of rotating speed at least twice during one longitudinal alignment operation; and aligning, with a paddle provided above the processing tray, the recording medium stacked on the processing tray in the longitudinal direction.

12. The method according to claim 11, further comprising setting a maximum of the rotating speed of the longitudinal alignment roller according to a type of the recording medium.

13. The method according to claim 12, further comprising:

storing, in a correspondence table, a maximum of the rotating speed set in advance according to the type of the recording medium; and setting the maximum of the rotating speed by reading the maximum of the rotating speed from the correspondence table on the basis of the type of the recording medium.

14. The method according to claim 11, wherein the paddle includes:

a paddle roller configured to rotate around a rotation axis;

a striking paddle configured to strike the recording medium;

a dropping paddle configured to drop the recording medium;

a draw-in paddle configured to draw in the recording medium; and a supporting member configured to support the draw-in paddle from a back in a rotating direction of the paddle.

15. The method according to claim 14, wherein the paddle is arranged right above the longitudinal alignment roller.

16. The method according to claim 15, wherein, when the longitudinal alignment roller is driven, the paddle is driven in synchronization with the longitudinal alignment roller and, when the longitudinal alignment roller is stopped, the paddle is stopped in synchronization with the longitudinal alignment roller.

17. The method according to claim 16, wherein the paddle further includes a dropping-paddle supporting member configured to support the dropping paddle from the back in the rotating direction.

18. The method according to claim 17, wherein the paddle includes the draw-in paddle in the dropping-paddle supporting member.

19. The method according to claim 18, wherein the paddle further includes a draw-in-paddle supporting member configured to support the draw-in paddle from the back in the rotating direction.

20. The method according to claim 19, wherein the draw-in paddle is set to be translated to an upstream side in the rotating direction with respect to a radius of the paddle roller.

* * * * *